US009734773B2

(12) United States Patent
Kang et al.

(10) Patent No.: US 9,734,773 B2
(45) Date of Patent: Aug. 15, 2017

(54) DISPLAY IMPROVEMENT METHOD AND APPARATUS FOR LIQUID CRYSTAL DISPLAY PANEL

(71) Applicant: Shenzhen China Star Optoelectronics Technology Co., Ltd., Guangdong (CN)

(72) Inventors: Chih-tsung Kang, Guangdong (CN); Lixuan Chen, Guangdong (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 178 days.

(21) Appl. No.: 14/780,534

(22) PCT Filed: Aug. 11, 2015

(86) PCT No.: PCT/CN2015/086664

§ 371 (c)(1),
(2) Date: Sep. 26, 2015

(87) PCT Pub. No.: WO2017/008362

PCT Pub. Date: Jan. 19, 2017

(65) Prior Publication Data

US 2017/0162136 A1 Jun. 8, 2017

(30) Foreign Application Priority Data

Jul. 14, 2015 (CN) ..... 2015 1 0414986

(51) Int. Cl.
*G09G 3/36* (2006.01)

(52) U.S. Cl.
CPC ..... *G09G 3/3607* (2013.01); *G09G 2320/028* (2013.01); *G09G 2320/0233* (2013.01);
(Continued)

(58) Field of Classification Search
CPC .... G09G 3/2074; G09G 3/3607; G09G 3/364; G09G 2320/0233; G09G 2320/0242;
(Continued)

(56) References Cited

U.S. PATENT DOCUMENTS 6,778,182 B2 * 8/2004 Yamakawa ..... G09G 3/20 345/22
7,978,927 B2 * 7/2011 Kao et al. ..... G06T 5/009 382/167

(Continued)

FOREIGN PATENT DOCUMENTS

CN 101297348 10/2008
CN 102258556 11/2011

(Continued)

OTHER PUBLICATIONS

International Search Report for PCT/CN2015/086664, Completed by the Chinese Patent Office, Dated Mar. 29, 2016, 10 Pages.

*Primary Examiner* — Gene W Lee
(74) *Attorney, Agent, or Firm* — Brooks Kushman P.C.

(57) ABSTRACT

A display improvement method and apparatus for a LCD panel are provided. The method includes: acquiring a gamma curve for at least one kind of color sub-pixel of a variety of color sub-pixels in a case of a side view; determining a luminance enhancement starting point on the gamma curve, according to tangent slopes of points corresponding to respective gray-scale values on the acquired gamma curve, wherein a gray-scale value of the luminance enhancement starting point is j, and the luminance enhancement starting point has a tangent slope less than tangent slopes of points having gray scale values (j−1) and (j+1) on the gamma curve; increasing a luminance value of a point having a gray-scale value greater than or equal to the gray-scale value of the luminance enhancement starting
(Continued)

point and less than a maximum gray-scale value on the gamma curve.

14 Claims, 2 Drawing Sheets

(52) U.S. Cl.
CPC ..... *G09G 2320/0247* (2013.01); *G09G 2320/0673* (2013.01)

(58) Field of Classification Search
CPC ..... G09G 2320/028; G09G 2320/0673; G09G 2320/068
See application file for complete search history.

(56) References Cited

U.S. PATENT DOCUMENTS

| | | | | |
|---|---|---|---|---|
| 8,305,316 | B2 | 11/2012 | Irie et al. | |
| 8,371,696 | B2 * | 2/2013 | Johansson | A61B 3/024 351/205 |
| 8,508,449 | B2 | 8/2013 | Broughton et al. | |
| 8,896,729 | B2 * | 11/2014 | Hara | H04N 5/202 348/222.1 |
| 8,952,978 | B2 | 2/2015 | Ogita et al. | |
| 9,214,114 | B2 * | 12/2015 | Liu | G09G 3/20 |
| 9,613,562 | B2 * | 4/2017 | Lee et al. | G09G 3/3208 |
| 2008/0219551 | A1 * | 9/2008 | Kao et al. | G06T 5/009 382/167 |
| 2011/0134160 | A1 | 6/2011 | Okishiro et al. | |
| 2012/0236262 | A1 * | 9/2012 | Johansson | A61B 3/024 351/224 |
| 2013/0120620 | A1 * | 5/2013 | Hara | H04N 5/202 348/251 |
| 2013/0321483 | A1 * | 12/2013 | You et al. | G09G 5/10 345/690 |
| 2014/0225942 | A1 * | 8/2014 | Liu | G09G 3/20 345/694 |
| 2015/0138260 | A1 | 5/2015 | Yamakawa | |
| 2016/0180809 | A1 * | 6/2016 | Mickelsen et al. | H04N 21/42221 345/207 |

FOREIGN PATENT DOCUMENTS

| | | |
|---|---|---|
| CN | 102419960 | 4/2012 |
| CN | 104167194 | 11/2014 |
| CN | 104350539 | 2/2015 |
| JP | 2009053589 | 3/2009 |

* cited by examiner

DISPLAY IMPROVEMENT METHOD AND APPARATUS FOR LIQUID CRYSTAL DISPLAY PANEL

CROSS-REFERENCE TO RELATED APPLICATION

This application is the U.S. national phase of PCT Application No. PCT/CN2015/086664 filed on Aug. 11, 2015, which claims priority to CN Patent Application No. 201510414986.1 filed on Jul. 14, 2015, the disclosures of which are incorporated in their entirety by reference herein.

BACKGROUND

1. Technical Field

The present invention relates to liquid crystal display technical field, and more particularly, to a display improvement method of a liquid crystal display (LCD) panel and a display improvement apparatus thereof.

2. Background Art

In recent years, LCDs gradually replace conventional Cathode Ray Tube (CRT) displays because of their merits of small volume, light weight and high display quality and so on. As the LCD is continuously applied, users' demand for a view angle of the LCD is gradually increased. Thus, a wide-angle LCD provided with a wider viewable angle is developed, such as a VA-type LCD or the like.

CNCA/CTS 0019-2013 CESI Specification prescribed in "Ultra High-Definition Display Certification Technical Specifications" provides nine standards for a chrominance viewing angle, wherein the chrominance viewing angle is a horizontal viewing angle when a chromatic aberration is 0.02 in a center of a screen. Currently, there is still a problem of a color bias while looking at the wide-angle LCD from a side view, so that the chrominance viewing angle is too small to satisfy the requirement of the users for a larger view angle of the LCD.

In particular, FIG. 1 shows gamma curves of color sub-pixels acquired in cases of a front view and a side view. As shown in FIG. 1, a gray-scale inversion phenomenon apparently exists in a gamma curve of each color sub-pixel (i.e., a red sub-pixel, a green sub-pixel, a blue sub-pixel, or a white sub-pixel) acquired in a case of the side view (e.g., observing the LCD panel from an angle of 60° with respect to a vertical direction of the LCD panel), and such gamma curve has a great difference from a gamma curve of each color sub-pixel acquired in a case of the front view (e.g., observing the LCD panel from an angle of 0° with respect to the vertical direction of the LCD panel). That is, the color difference is great, so that the viewing angle is too small.

FIG. 2 shows gamma curves of color sub-pixels acquired in a case of the side view after a BH/BL conversion is performed. The BH/BL conversion refers to that all the blue sub-pixels on the LCD panel are divided into blue sub-pixel pairs each consisting of two blue sub-pixels, and a first blue sub-pixel of each blue sub-pixel pair is provided with a high gray-scale value, and a second blue sub-pixel thereof is provided with a low gray-scale value. As shown in FIG. 2, a gray-scale inversion phenomenon existed in the gamma curve of each color sub-pixel (i.e., a red sub-pixel, a green sub-pixel, or a blue sub-pixel) acquired in a case of the side view after the BH/BL conversion is performed, is greatly reduced. However, the gray-scale inversion phenomenon still exists even after the BH/BL conversion is performed due to practical limitations such as data measurement errors, circuit signal control limit, prevention of brightness flickering in a space and so on. Thus, the gamma curve in a case of the side view cannot overlap with or have a small difference from the gamma curve of the color sub-pixel acquired in a case of the front view. Therefore, a color difference still exists, and a requirement of the users for a large viewing angle cannot be satisfied.

SUMMARY

Exemplary embodiments of the present invention aim to provide a display improvement method and apparatus for a LCD panel, which can overcome a problem of an existence of a color bias while looking at the LCD panel from a side view.

According to an exemplary embodiment of the present invention, a display improvement method for a LCD panel is provided, wherein each pixel on the LCD panel includes a variety of color sub-pixels, the method including: acquiring a gamma curve for at least one kind of color sub-pixel of the variety of color sub-pixels in a case of a side view; determining a luminance enhancement starting point on the gamma curve, according to tangent slopes of points corresponding to respective gray-scale values on the acquired gamma curve, wherein a gray-scale value of the luminance enhancement starting point is j, and the luminance enhancement starting point has a tangent slope less than tangent slopes of points having gray-scale values (j−1) and (j+1) on the gamma curve; increasing a luminance value of a point having a gray-scale value greater than or equal to the gray-scale value of the luminance enhancement starting point and less than a maximum gray-scale value on the gamma curve.

In the increasing of the luminance value, given that an original luminance value of a point having a gray-scale value k on the gamma curve is Lv(k), a new luminance value Lv(k)' of the point is calculated through the following equation, wherein k is an integer greater than or equal to j and less than m, and m is the maximum gray-scale value:

$$Lv(k)'=f*Lv(k),$$

wherein f∈(1, Lv(m)/Lv(k)], and Lv(m) is an original luminance value of a point having a gray-scale value m on the gamma curve.

In the increasing of the luminance value, given that an original luminance value of a point having a gray-scale value k on the gamma curve is Lv(k), a new luminance value Lv(k)' of the point is calculated through the following equation, wherein k is an integer greater than or equal to j and less than m, and m is the maximum gray-scale value:

$$Lv(k)'=(k/m)^{(m*\gamma(k))}*LV(m),$$

wherein Lv(m) is an original luminance value of a point having a gray-scale value m on the gamma curve, and γ is a predetermined gamma value.

In the increasing of the luminance value, given that an original luminance value of a point having a gray-scale value k on the gamma curve is Lv(k), a new luminance value Lv(k)' of the point is calculated through the following equation, wherein k is an integer greater than or equal to j and less than m, and m is the maximum gray-scale value:

$$Lv(k)'=(k/m)^{gamma(k)'}*Lv(m),$$

wherein Lv(m) is an original luminance value of a point having a gray-scale value m on the gamma curve; gamma(k)' is a gamma value of a point having a gray-scale value k and a luminance value Lv(k)', and gamma(k)' satisfies the following conditions: gamma(k)+⟨gamma(k), and Lv(k)'≤Lv (m), where gamma(k) is a gamma value of the point having the gray-scale k on the gamma curve, and gamma(k)=lg(Lv(k)/Lv(m))/lg(k/m).

γ is a value less than 2.2.

The case of the side view refers to observing the LCD panel in a view angle which is a predetermined angle with respect to a vertical direction of the LCD panel.

Each pixel on the LCD panel includes a blue sub-pixel. On the LCD panel, all the blue sub-pixels are divided into blue sub-pixel pairs each consisting of two blue sub-pixels, and a first blue sub-pixel of each blue sub-pixel pair is provided with a high gray-scale value, and a second blue sub-pixel of each blue sub-pixel pair is provided with a low gray-scale value.

According to another exemplary embodiment of the present invention, a display improvement apparatus for a LCD panel is provided, wherein each pixel on the LCD panel includes a variety of color sub-pixels, the apparatus comprising: a gamma curve acquisition unit for acquiring a gamma curve for at least one kind of color sub-pixel of the variety of color sub-pixels in a case of a side view; a luminance enhancement starting point determination unit for determining a luminance enhancement starting point on the gamma curve, according to tangent slopes of points corresponding to respective gray-scale values on the acquired gamma curve, wherein a gray-scale value of the luminance enhancement starting point is j, and the luminance enhancement starting point has a tangent slope less than tangent slopes of points having gray-scale values (j−1) and (j+1) on the gamma curve; a luminance value increasing unit for increasing a luminance value of a point having a gray-scale value greater than or equal to the gray-scale value of the luminance enhancement starting point and less than a maximum gray-scale value on the gamma curve.

Given that an original luminance value of a point having a gray-scale value k on the gamma curve is Lv(k), the luminance value increasing unit acquires a new luminance value Lv(k)' of the point through the following equation, wherein k is an integer greater than or equal to j and less than m, and m is the maximum gray-scale value:

$$Lv(k)'=f*Lv(k),$$

wherein f∈(1, Lv(m)/Lv(k)], and Lv(m) is an original luminance value of a point having a gray-scale value m on the gamma curve.

Given that an original luminance value of a point having a gray-scale value k on the gamma curve is Lv(k), the luminance value increasing unit acquires a new luminance value Lv(k)' of the point through the following equation, wherein k is an integer greater than or equal to j and less than m, and m is the maximum gray-scale value:

$$Lv(k)'=(k/m)^{(m*\gamma/k)}*Lv(m),$$

wherein Lv(m) is an original luminance value of a point having a gray-scale value m on the gamma curve, and γ is a predetermined gamma value.

Given that an original luminance value of a point having a gray-scale value k on the gamma curve is Lv(k), the luminance value increasing unit acquires a new luminance value Lv(k)' of the point through the following equation, wherein k is an integer greater than or equal to j and less than m, and m is the maximum gray-scale value:

$$Lv(k)'=(k/m)^{gamma(k)'}*Lv(m),$$

wherein Lv(m) is an original luminance value of a point having a gray-scale value m on the gamma curve; gamma(k)' is a gamma value of a point having a gray-scale value k and a luminance value Lv(k)', and gamma(k)' satisfies the following conditions: gamma(k)'⟨gamma(k), and Lv(k)'≤Lv(m), where gamma(k) is a gamma value of the point having the gray-scale k on the gamma curve, and gamma(k)=lg(Lv(k)/Lv(m))/lg(k/m).

γ is a value less than 2.2.

In the display improvement method and apparatus for the LCD panel according to the exemplary embodiments of the present invention, the problem of the existence of the color bias while looking at the LCD panel from the side view is improved by increasing luminance of at least one kind of color sub-pixel at high gray-scale, thereby effectively increasing a viewing angle to satisfy a requirement of users for a large view angle of the LCD panel.

Other aspects and/or advantages of the general concept of the present invention will be set forth in part in the description which follows and, in part, will be apparent from the description, or may be learned by practice of the presented exemplary embodiments.

DETAILED DESCRIPTION

Figure 1:
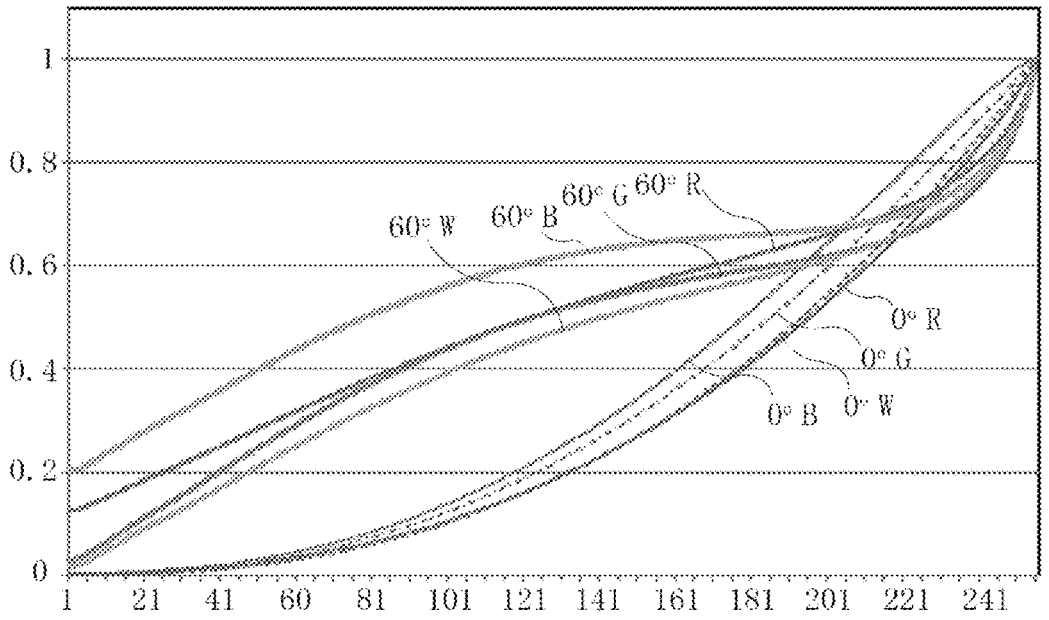
FIG. 1 illustrates gamma curves of color sub-pixels acquired in cases of a front view and a side view.
Figure 2:
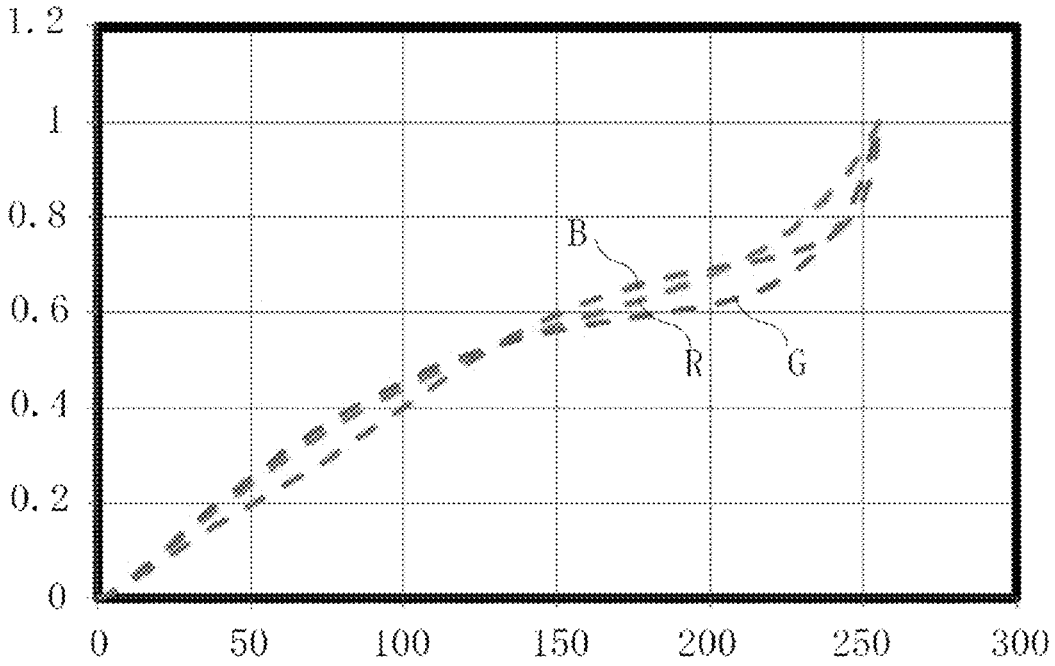
FIG. 2 illustrates gamma curves of color sub-pixels acquired in a case of a side view after a BH/BL conversion is performed.

Reference will now be made in detail to exemplary embodiments of the present invention, which are illustrated in the accompanying drawings, wherein like reference numerals refer to like elements throughout. The embodiments are described below, by referring to the figures, to explain the present invention.

Hereinafter, a display improvement method for a LCD panel according to an exemplary embodiment of the present invention will be described by referring to FIG. 3. The method may be implemented by the LCD, or a computer program, so that the above method may be achieved while running the program.

Figure 3:
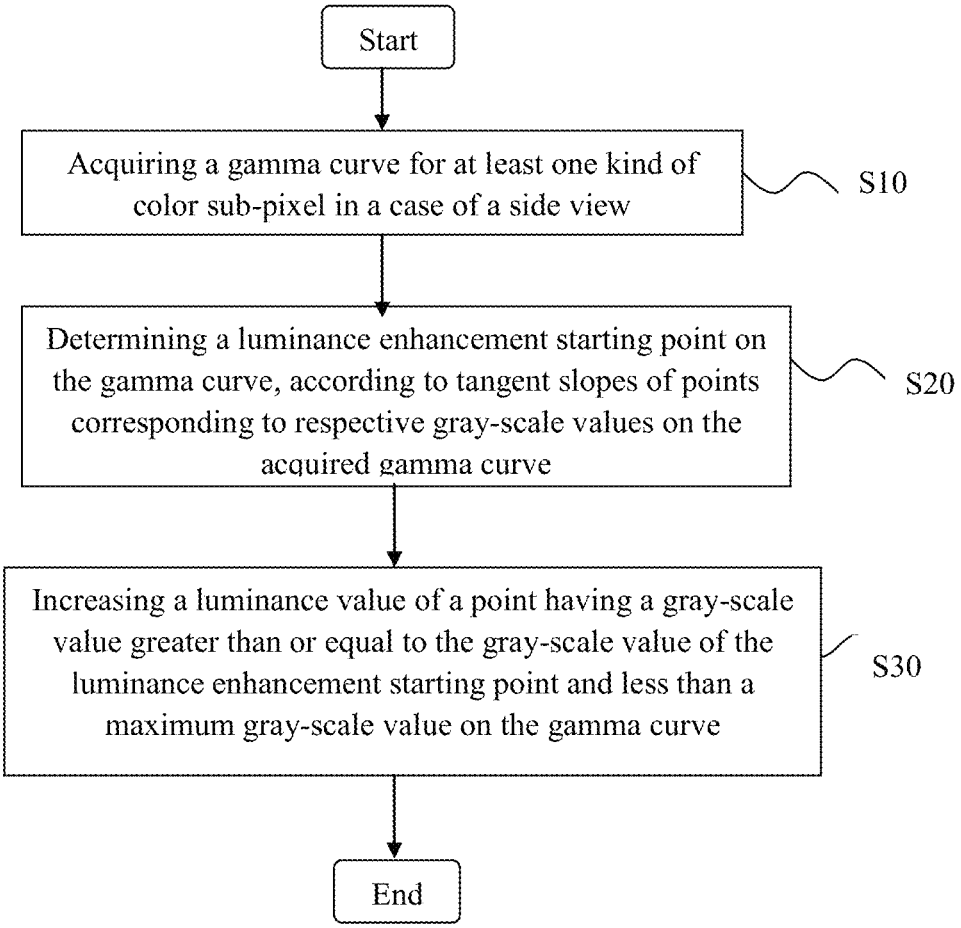
FIG. 3 is a flowchart illustrating a display improvement method for a LCD panel according to an exemplary embodiment of the present invention.

FIG. 3 is a flowchart illustrating a display improvement method for a LCD panel according to an exemplary embodiment of the present invention. Each pixel on the LCD panel includes a variety of color sub-pixels. For example, if the LCD panel is a RGB LCD panel, each pixel on the LCD panel includes a red sub-pixel, a green sub-pixel, and a blue sub-pixel. If the LCD panel is a RGBW LCD panel, each pixel on the LCD panel includes a red sub-pixel, a green sub-pixel, a blue sub-pixel, and a white sub-pixel. If the LCD panel is a RGBY LCD panel, each pixel on the LCD panel includes a red sub-pixel, a green sub-pixel, a blue sub-pixel, and a yellow sub-pixel.

Referring to FIG. 3, in Step S10, a gamma curve in a case of a side view is acquired for at least one kind of color sub-pixel of a variety of color sub-pixels.

Here, the case of the side view refers to observing the LCD panel in a view angle which is a predetermined angle with respect to a vertical direction of the LCD panel. The predetermined angle may be any one angle within the range from 30° to 80°. It should be understood that the predetermined angle is associated with a desired viewing angle of the LCD panel, that is, the larger the desired viewing angle of the LCD panel is, the larger the predetermined angle should be.

As an example, the gamma curve about gray-scale values and luminance values of the color sub-pixel is acquired, according to the luminance values at the respective gray-scales of the color sub-pixel measured in a case of the side view. It should be understood that the gamma curve of the color sub-pixel in a case of the side view may be acquired through other means.

In Step S20, a luminance enhancement starting point on the gamma curve may be determined, according to tangent slopes of points corresponding to respective gray-scale values on the acquired gamma curve, where a gray-scale value of the luminance enhancement starting point is j, and the luminance enhancement starting point has a tangent slope less than tangent slopes of points having gray-scale values (j−1) and (j+1) on the gamma curve.

In other words, if the tangent slopes of the points on the gamma curve are decreased and then increased as the gray-scale value is increased, the point at which the tangent slope is starting to be increased is determined as the luminance enhancement starting point.

In Step S30, luminance values of points each having a gray-scale value greater than or equal to the gray-scale value of the luminance enhancement starting point and less than a maximum gray-scale value on the gamma curve are increased.

In other words, a luminance enhancement is performed on the luminance of all the points having the gray-scale value greater than or equal to j on the gamma curve except the point having the maximum gray-scale value on the gamma curve, so as to reduce or eliminate a gray-scale inversion phenomenon of the gamma curve, so that the gamma curve overlaps with or has less difference from the gamma curve in a case of a front view as far as possible, thereby eliminating a color bias phenomenon existed in a case of the side view.

It should be understood that luminance values of the points each having a gray-scale value greater than or equal to the gray-scale value of the luminance enhancement starting point and less than the maximum gray-scale value on the gamma curve may be increased through various means. Given that an original luminance value of a point having a gray-scale value k on the gamma curve is Lv(k), a new luminance value acquired by increasing the luminance value of the point is Lv(k)', where k is an integer greater than or equal to j and less than m, and m is the maximum gray-scale value, and Lv(m) is an original luminance value of a point having a gray-scale value m on the gamma curve. Moreover, it should be noted that the new luminance value Lv(k)' should not exceed Lv(m).

Here, a number of gray-scales varies according to the different LCD panels. For example, when the LCD panel is a 8-bit LCD panel, the number of gray-scales is 256. The gray-scales are represented by 0, 1, 2 . . . , 255 in sequence. At the moment, a minimum gray-scale value is 0, and a maximum gray-scale value is 255. For example, when the LCD panel is a 10-bit LCD panel, the number of gray-scales is 1024. The gray-scales are represented by 0, 1, 2 . . . , 1023 in sequence. At the moment, a minimum gray-scale value is 0, and a maximum gray-scale value is 1023.

As a first example, a new luminance value Lv(k)' of the point is acquired through the following equation:

$$Lv(k)'=f*Lv(k),$$

where f∈(1, Lv(m)/Lv(k)], and a specific value of f may be set according to experience and the specific situation.

As a second example, a new luminance value Lv(k)' of the point is acquired through the following equation:

$$Lv(k)'=(k/m)^{(m*\gamma/k)}*Lv(m),$$

where γ is a predetermined gamma value. Here, γ is a value less than 2.2, and a specific value of γ may be set according to experience and the specific situation. Preferably, γ may be 1.8.

As a third example, a new luminance value Lv(k)' of the point is acquired through the following equation:

$$Lv(k)'=(k/m)^{gamma(k)+}*Lv(m),$$

where gamma(k)' is a gamma value of a point having a gray-scale value k and a luminance value Lv(k)', gamma(k)' satisfies the following conditions: gamma(k)'⟨gamma(k) and Lv(k)'≤Lv(m), where gamma(k) is a gamma value of the point having the gray-scale k on the gamma curve, gamma (k)=lg(Lv(k)/Lv(m))/lg(k/m).

In addition, as an example, each pixel on the LCD panel may include a blue sub-pixel. On the LCD panel, all the blue sub-pixels are divided into blue sub-pixel pairs each consisting of two blue sub-pixels, and a first blue sub-pixel of each blue sub-pixel pair is provided with a high gray-scale value, and a second blue sub-pixel of each blue sub-pixel pair is provided with a low gray-scale value. Thus, the gray-scale inversion phenomenon on the gamma curve in a case of the side view may be better eliminated, thereby reducing the color bias in a case of the side view.

Figure 4:
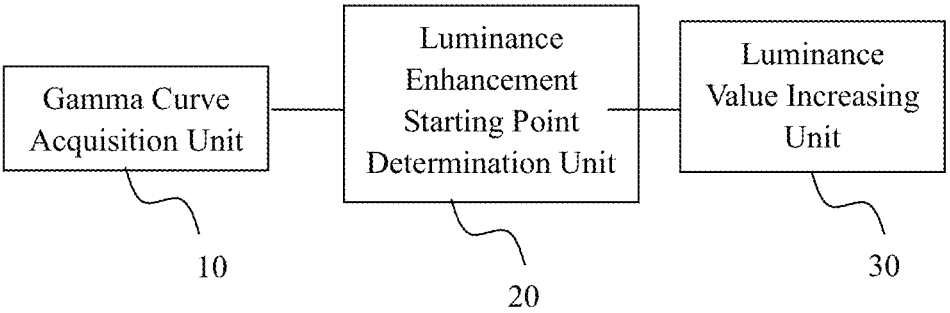
FIG. 4 is a block diagram illustrating a display improvement apparatus for a LCD panel according to an exemplary embodiment of the present invention.

FIG. 4 is a block diagram illustrating a display improvement apparatus for a LCD panel according to an exemplary embodiment of the present invention. Here, each pixel on the LCD panel includes a variety of color sub-pixels. For example, if the LCD panel is a RGB LCD panel, each pixel on the LCD panel includes a red sub-pixel, a green sub-pixel, and a blue sub-pixel. If the LCD panel is a RGBW LCD panel, each pixel on the LCD panel includes a red sub-pixel, a green sub-pixel, a blue sub-pixel, and a white sub-pixel. If the LCD panel is a RGBY LCD panel, each pixel on the LCD panel includes a red sub-pixel, a green sub-pixel, a blue sub-pixel, and a yellow sub-pixel.

As shown in FIG. 4, the display improvement apparatus for the LCD panel according to an exemplary embodiment of the present invention includes a gamma curve acquisition unit 10, a luminance enhancement starting point determination unit 20, and a luminance value increasing unit 30. These units may be implemented by general hardware processors, such as a digital signal processor, a field-programmable gate array (FPGA) etc., or a specialized hardware processor, such as a specialized chip or the like, or may be implemented totally by a computer program in a manner of a software, e.g., these units may be implemented as respective modules of a software mounted in the LCD display.

In particular, the gamma curve acquisition unit 10 acquires a gamma curve for at least one kind of color sub-pixel of the variety of color sub-pixels in a case of a side view.

Here, the case of the side view refers to observing the LCD panel in a view angle which is a predetermined angle with respect to a vertical direction of the LCD panel. The predetermined angle may be any one angle within the range from 30° to 80°. It should be understood that the predetermined angle is associated with a desired viewing angle of the LCD panel, that is, the larger the desired viewing angle of the LCD panel is, the larger the predetermined angle should be.

As an example, the gamma curve acquisition unit 10 acquires the gamma curve about gray-scale values and luminance values of the color sub-pixel, according to the luminance values at the respective gray-scales of the color sub-pixel measured in a case of the side view. It should be understood that the gamma curve acquisition unit 10 may acquire the gamma curve of the color sub-pixel in a case of the side view through other means.

The luminance enhancement starting point determination unit 20 determines a luminance enhancement starting point on the gamma curve, according to tangent slopes of points corresponding to respective gray-scale values on the acquired gamma curve, where a gray-scale value of the luminance enhancement starting point is j, and the luminance enhancement starting point has a tangent slope less than tangent slopes of points having gray scale values (j−1) and (j+1) on the gamma curve.

In other words, if the tangent slopes of the points on the gamma curve are decreased and then increased as the gray-scale value is increased, the luminance enhancement starting point determination unit 20 may determine a point at which the tangent slope is starting to be increased as the luminance enhancement starting point.

The luminance value increasing unit 30 increases luminance values of points each having a gray-scale value greater than or equal to the gray-scale value of the luminance enhancement starting point and less than a maximum gray-scale value on the gamma curve.

In other words, the luminance value increasing unit 30 performs a luminance enhancement on all the points having the gray-scale value greater than or equal to j on the gamma curve except the point having the maximum gray-scale value on the gamma curve, so as to reduce or eliminate a gray-scale inversion phenomenon of the gamma curve, so that the gamma curve overlaps with or has less difference from the gamma curve in a case of the front view as far as possible, thereby eliminating a color bias phenomenon existed in a case of the side view.

It should be understood that the luminance value increasing unit 30 may increase luminance values of the points each having a gray-scale value greater than or equal to the gray-scale value of the luminance enhancement starting point and less than the maximum gray-scale value on the gamma curve through various means. Given that an original luminance value of a point having a gray-scale value k on the gamma curve is Lv(k), a new luminance value acquired by increasing the luminance value of the point is Lv(k)', where k is an integer greater than or equal to j and less than m, and m is the maximum gray-scale value, and Lv(m) is an original luminance value of a point having a gray-scale value m on the gamma curve. Moreover, it should be noted that the new luminance value Lv(k)' should not exceed Lv(m).

Here, a number of gray-scales varies according to the different LCD panels. For example, when the LCD panel is a 8-bit LCD panel, the number of gray-scales is 256. The gray-scales are represented by 0, 1, 2 . . . , 255 in sequence. At the moment, a minimum gray-scale value is 0, and a maximum gray-scale value is 255. For example, when the LCD panel is a 10-bit LCD panel, the number of gray-scales is 1024. The gray-scales are represented by 0, 1, 2 . . . , 1023 in sequence. At the moment, a minimum gray-scale value is 0, and a maximum gray-scale value is 1023.

As a first example, the luminance value increasing unit 30 acquires a new luminance value Lv(k)' of the point through the following equation:

$$Lv(k)'=f*Lv(k),$$

where f∈(1, Lv(m)/Lv(k)], and a specific value off may be set according to experience and the specific situation.

As a second example, the luminance value increasing unit 30 acquires a new luminance value Lv(k)' of the point through the following equation:

$$Lv(k)=(k/m)^{(m*\gamma/k)}*Lv(m),$$

where γ is a predetermined gamma value. Here, γ is a value less than 2.2, and a specific value of γ may be set according to experience and the specific situation. Preferably, γ may be 1.8.

As a third example, the luminance value increasing unit 30 acquires a new luminance value Lv(k)' of the point through the following equation:

$$Lv(k)'=(k/m)^{gamma(k)'}*Lv(m),$$

where gamma(k)' is a gamma value of the point having a gray-scale value k and a luminance value Lv(k)', gamma(k)' satisfies the following conditions: gamma(k)'⟨gamma(k) and Lv(k)'≤Lv(m), where gamma(k) is a gamma value of the point having a gray-scale k on the gamma curve, gamma (k)=lg(Lv(k)/Lv(m))/lg(k/m).

In addition, as an example, each pixel on the LCD panel may include a blue sub-pixel. On the LCD panel, all the blue sub-pixels are divided into blue sub-pixel pairs each consisting of two blue sub-pixels, and a first blue sub-pixel of each blue sub-pixel pair is provided with a high gray-scale value, and a second blue sub-pixel of each blue sub-pixel pair is provided with a low gray-scale value. Thus, the gray-scale inversion phenomenon on the gamma curve in a case of the side view may be better eliminated, thereby reducing the color bias in a case of the side view.

The display improvement method and apparatus for the LCD panel according to the exemplary embodiments of the present invention can improve a problem of an existence of a color bias while looking at the LCD panel from the side view by increasing luminance of at least one kind of color sub-pixel at high gray-scale, thereby effectively increasing the viewing angle to satisfy a requirement of the users for a large angle of the LCD panel.

While a few exemplary embodiments have been shown and described, it will be understood by those skilled in the art that the changes may be made therein without departing from the spirit and scope of the present invention as defined by the appended claims and the equivalents thereof.

What is claimed is:

1. A display improvement method for a liquid crystal display (LCD) panel, wherein each pixel on the LCD panel includes a variety of color sub-pixels, the method comprising:

acquiring a gamma curve for at least one kind of color sub-pixel of the variety of color sub-pixels in a case of a side view;

determining a luminance enhancement starting point on the gamma curve, according to tangent slopes of points corresponding to respective gray-scale values on the acquired gamma curve, wherein a gray-scale value of the luminance enhancement starting point is j, and the luminance enhancement starting point has a tangent slope less than tangent slopes of points having gray-scale values (j−1) and (j+1) on the gamma curve;

increasing a luminance value of a point having a gray-scale value greater than or equal to the gray-scale value of the luminance enhancement starting point and less than a maximum gray-scale value on the gamma curve.

2. The method of claim 1, wherein in the increasing of the luminance value, given that an original luminance value of a point having a gray-scale value k on the gamma curve is Lv(k), a new luminance value Lv(k)' of the point is calculated through following the equation, wherein k is an integer greater than or equal to j and less than m, and m is the maximum gray-scale value:

$$Lv(k)'=f*Lv(k),$$

wherein f∈(1, Lv(m)/Lv(k)], and Lv(m) is an original luminance value of a point having a gray-scale value m on the gamma curve.

3. The method of claim 1, wherein in the increasing of the luminance value, given that an original luminance value of a point having a gray-scale value k on the gamma curve is Lv(k), a new luminance value Lv(k)' of the point is calculated through the following equation, wherein k is an integer greater than or equal to j and less than m, and m is the maximum gray-scale value:

$$Lv(k)'=(k/m)^{(m*\gamma/k)}*Lv(m),$$

wherein Lv(m) is an original luminance value of a point having a gray-scale value m on the gamma curve, and γ is a predetermined gamma value.

4. The method of claim 3, wherein γ is a value less than 2.2.

5. The method of claim 1, wherein in the increasing of the luminance value, given that an original luminance value of a point having a gray-scale value k on the gamma curve is Lv(k), a new luminance value Lv(k)' of the point is calculated through the following equation, wherein k is an integer greater than or equal to j and less than m, and m is the maximum gray-scale value:

$$Lv(k)'=(k/m)^{gamma(k)'}*Lv(m),$$

wherein Lv(m) is an original luminance value of a point having a gray-scale value m on the gamma curve; gamma(k)' is a gamma value of a point having a gray-scale value k and a luminance value Lv(k)', and gamma(k)' satisfies the following conditions: gamma(k)'⟨gamma(k), and Lv(k)'≤Lv(m), where gamma(k) is a gamma value of the point having the gray-scale k on the gamma curve, and gamma(k)=lg(Lv(k)/Lv(m))/lg(k/m).

6. The method of claim 1, wherein the case of the side view refers to observing the LCD panel in a view angle which is a predetermined angle with respect to a vertical direction of the LCD panel.

7. The method of claim 1, wherein each pixel on the LCD panel includes a blue sub-pixel, on the LCD panel, all the blue sub-pixels are divided into blue sub-pixel pairs each consisting of two blue sub-pixels, a first blue sub-pixel of each blue sub-pixel pair is provided with a high gray-scale value, and a second blue sub-pixel of each blue sub-pixel pair is provided with a low gray-scale value.

8. A display improvement apparatus for a LCD panel, wherein each pixel on the LCD panel includes a variety of color sub-pixels, the apparatus comprising:

a gamma curve acquisition unit for acquiring a gamma curve for at least one kind of color sub-pixel of the variety of color sub-pixels in a case of a side view;

a luminance enhancement starting point determination unit for determining a luminance enhancement starting point on the gamma curve, according to tangent slopes of points corresponding to respective gray-scale values on the acquired gamma curve, wherein a gray-scale value of the luminance enhancement starting point is j, and the luminance enhancement starting point which has a tangent slope less than tangent slopes of points having gray-scale values (j−1) and (j+1) on the gamma curve;

a luminance value increasing unit for increasing a luminance value of a point having a gray-scale value greater than or equal to the gray-scale value of the luminance enhancement starting point and less than a maximum gray-scale value on the gamma curve.

9. The apparatus of claim 8, wherein given that an original luminance value of a point having a gray-scale value k on the gamma curve is Lv(k), the luminance value increasing unit acquires a new luminance value Lv(k)' of the point through the following equation, wherein k is an integer greater than or equal to j and less than m, and m is the maximum gray-scale value:

$$Lv(k)'=f*Lv(k),$$

wherein f∈(1, Lv(m)/Lv(k)], and Lv(m) is an original luminance value of a point having a gray-scale value m on the gamma curve.

10. The apparatus of claim 8, wherein given that an original luminance value of a point having a gray-scale value k on the gamma curve is Lv(k), the luminance value increasing unit acquires a new luminance value Lv(k)' of the point through the following equation, wherein k is an integer greater than or equal to j and less than m, and m is the maximum gray-scale value:

$$Lv(k)'=(k/m)^{(m*\gamma/k)}*Lv(m),$$

wherein Lv(m) is an original luminance value of a point having a gray-scale value m on the gamma curve, and γ is a predetermined gamma value.

11. The apparatus of claim 10, wherein γ is a value less than 2.2.

12. The apparatus of claim 8, wherein given that an original luminance value of a point having a gray-scale value k on the gamma curve is Lv(k), the luminance value increasing unit acquires a new luminance value Lv(k)' of the point through the following equation, wherein k is an integer greater than or equal to j and less than m, and m is the maximum gray-scale value:

$$Lv(k)'=(k/m)^{gamma(k)'}*Lv(m),$$

wherein Lv(m) is an original luminance value of a point having a gray-scale value m on the gamma curve; gamma(k)' is a gamma value of a point having a gray-scale value k and a luminance value Lv(k)', and gamma(k)' satisfies the following conditions: gamma(k)'≤⟨gamma(k), and Lv(k)'≤Lv(m), where gamma(k) is a gamma value of the point having the gray-scale k on the gamma curve, and gamma(k)=lg(Lv(k)/Lv(m))/lg(k/m).

13. The apparatus of claim 8, wherein the case of the side view refers to observing the LCD panel in a view angle which is a predetermined angle with respect to a vertical direction of the LCD panel.

14. The apparatus of claim 8, wherein each pixel on the LCD panel includes a blue sub-pixel, on the LCD panel, all the blue sub-pixels are divided into blue sub-pixel pairs each consisting of two blue sub-pixels, a first blue sub-pixel of each blue sub-pixel pair is provided with a high gray-scale value, and a second blue sub-pixel of each blue sub-pixel pair is provided with a low gray-scale value.

* * * * *